US011485452B2

(12) United States Patent
Pompeia

(10) Patent No.: US 11,485,452 B2
(45) Date of Patent: Nov. 1, 2022

(54) HYBRID VESSEL COMPRISING BALLAST WATER SYSTEM

(71) Applicant: VOS PROJETOS DE ENGENHARIA LTDA, Sao Paulo (BR)

(72) Inventor: Caio Pompeia, São Paulo (BR)

(73) Assignee: VOS PROJETOS DE ENGENHARIA LTDA, Sao Paulo (BR)

( * ) Notice: Subject to any disclaimer, the term of this patent is extended or adjusted under 35 U.S.C. 154(b) by 37 days.

(21) Appl. No.: 17/058,972

(22) PCT Filed: May 24, 2019

(86) PCT No.: PCT/BR2019/050189
§ 371 (c)(1),
(2) Date: Nov. 25, 2020

(87) PCT Pub. No.: WO2019/222824
PCT Pub. Date: Nov. 28, 2019

(65) Prior Publication Data

US 2021/0221470 A1 Jul. 22, 2021

(30) Foreign Application Priority Data

May 25, 2018 (BR) ..... 10 2018 010733-0

(51) Int. Cl.
*B63B 1/10* (2006.01)
*B63B 3/13* (2006.01)
(Continued)

(52) U.S. Cl.
CPC ..... *B63B 1/107* (2013.01); *B63B 3/13* (2013.01); *B63B 13/00* (2013.01); *B63B 43/06* (2013.01);
(Continued)

(58) Field of Classification Search
CPC .. B63B 1/00; B63B 1/107; B63B 3/00; B63B 3/13; B63B 13/00; B63B 43/00;
(Continued)

(56) References Cited

U.S. PATENT DOCUMENTS 3,411,472 A 11/1968 Bajulaz
4,087,980 A 5/1978 Kono
(Continued)

FOREIGN PATENT DOCUMENTS

BR 11 2014 0168067 7/2014
BR 11 2015 0023398 2/2015
(Continued)

OTHER PUBLICATIONS

International Search Report for PCT/BR2019/050189 dated Aug. 8, 2019.

*Primary Examiner* — Lars A Olson
(74) *Attorney, Agent, or Firm* — B. Aaron Schulman, Esq.; Stites & Harbison, PLLC

(57) ABSTRACT

The present invention refers to a hybrid vessel with a ballast system in which the position of the cabin (102) is changed vertically, from emerged to submerged and vice versa, according to the decision of its operator.

Thus, the present invention describes a hybrid vessel with ballast water system comprising at least one cabin (102) and at least one main tank (101) of ballast water, and the tank (101) is connected directly to the CAB (102) or partially above the water level.

17 Claims, 11 Drawing Sheets

(51) Int. Cl.

| | |
|---|---|
| ***B63B 13/00*** | (2006.01) |
| ***B63B 43/06*** | (2006.01) |
| *B63B 19/00* | (2006.01) |

(52) U.S. Cl.
CPC ... *B63B 2019/0007* (2013.01); *B63B 2207/02* (2013.01); *B63B 2231/04* (2013.01); *B63B 2231/10* (2013.01); *B63B 2231/70* (2013.01)

(58) Field of Classification Search
CPC ..... B63B 43/06; B63B 2019/0007; B63B 2207/02; B63B 2231/04; B63B 2231/10; B63B 2231/70; B63G 8/00; B63G 8/22
USPC ..... 114/121
See application file for complete search history.

(56) References Cited

U.S. PATENT DOCUMENTS

| | | | |
|---|---|---|---|
| 4,276,851 | A | 7/1981 | Coleman |
| 4,823,722 | A | 4/1989 | Gass |
| 5,988,088 | A | 11/1999 | Ishida et al. |
| 6,321,676 | B1 | 11/2001 | Kohnen et al. |
| 7,234,407 | B1 | 6/2007 | Bern et al. |
| 8,869,724 | B2 | 10/2014 | Von Der Goltz et al. |
| 9,540,083 | B2 | 1/2017 | Von Der Goltz et al. |
| 10,000,264 | B2 | 6/2018 | Sheard |
| 2003/0164132 | A1 | 9/2003 | Wippermann |
| 2007/0137546 | A1 | 6/2007 | Bern et al. |
| 2013/0174768 | A1 | 7/2013 | Von Der Goltz et al. |
| 2015/0151818 | A1 | 6/2015 | Von Der Goltz et al. |
| 2016/0229503 | A1 | 8/2016 | Sheard |
| 2018/0290718 | A1 | 10/2018 | Sheard |

FOREIGN PATENT DOCUMENTS

| | | |
|---|---|---|
| BR | 11 2015 0250963 | 9/2015 |
| BR | 20 2013 0288557 | 10/2015 |
| BR | 11 2016 0065107 | 3/2016 |
| BR | 11 2013 0269839 | 1/2017 |
| CN | 2312874 | 4/1999 |
| CN | 101229842 | 7/2008 |
| CN | 201971130 | 9/2011 |
| CN | 104015890 | 9/2014 |
| CN | 203946251 | 11/2014 |
| JP | H 03273991 | 12/1991 |
| MU | 8300506-4 | 11/2004 |
| PL | 9300239 | 7/1993 |
| PL | 0316139-0 | 10/2005 |

HYBRID VESSEL COMPRISING BALLAST WATER SYSTEM

INVENTION FIELD

The present invention is inserted in the field of maritime transport, particularly related to vessels, more precisely to semi-submersible vessels and their systems of ballast water tanks.

STATE OF THE ART

By means of seas, lakes or rivers, water transport carries goods, cargo and/or passengers making short or long journeys, providing leisure service or specialized professional. In aquatic environment, to ensure static and dynamic stability, some vessels need storing water (ballast water) in storage tanks when navigating without loads. This fact aims to assure minimum equilibrium conditions for the manoeuvre of the vehicle, and it is common to find such tanks housed in the basements of vessels.

In commercial vessels, ballast water is used as an extra weight to compensate for weight loss due to cargo landing, since its structure is considerably lighter and would lose stability if it navigated with considerable pair of the hull out of the water, being able to adhere and embrocate due to extern conditions as waves movement and strong winds. The capture of ballast water usually occurs in port areas, through the use of pumps, pipes and valves, allowing thus the realization of landing and boarding operations of new loads securely to the boat.

Studies show that ballast is necessary to ensure structural integrity in the hull when the load is removed, control the trim of the vessel and submerge the hull sufficiently so that the rudder and the propeller operate efficiently.

Ballast Water Systems filled at the place of embarkation or disembarkation are widely used by various types of vessels.

Commercial vessels are large vessels, with one or more conveses, intended to carry passengers, goods or loads of materials and which use ballast water to maintain their stability when discharged into port areas. One of its properties is to keep its weight properly balanced in order to stay integral time floating with stability over the sea.

Undersea observation vehicles are generally geared towards offshore oil activity, scientific research, oceanographic observation or even underwater archaeology, and can also be used for leisure and activities related to underwater tourism. They can be civil or military type and use ballast water to control the weight needed for submersion. Unlike a ship, the submarine vehicle remains with the full-time underwater observation booth from the start of the journey to the sea-watching site.

There are also semisubmersible vehicles which, in turn, use their own weight as ballast and are commonly used for activities such as underwater observation, with the objective of tourism, underwater inspections, or military use. Such vehicles remain partially submerged throughout the journey between the port area and the observation site, generating greater drag on displacement. In addition, the fixed ballast significantly increases the weight of the vessel, decreasing its portability on land.

The ships are designed so that, even with cargo and passengers, weigh less than the water that would be displacing it by its hull in the maximum draught situation. In the event of occurrence of something that causes a rupture in the hull, the water inlet will reduce the vessel's support by causing it to sink. A submarine can modify its buoyancy by filling or emptying ballast tanks, which are reservoirs that occupy a significant part of the submarine. When a submarine is on the surface, also to any other ship, it possesses positive buoyancy. When on the surface, the ballast tanks are empty (no water, contains only air). To submerge, the valves are opened that make the air from the top of the ballast tanks come out, allowing the seawater to doubleand through openings located at the bottom of the tanks. As water penetrates into the tanks the submarine becomes heavier (1 $m^3$ of water weighs 840 times more than 1 $m^3$ of Air). The buoyancy becomes negative and the submarine sinks, i.e., submerge (Avancini, M. "Why ships float and submarines sink", UFRGS, 2003).

The amount of water in ballast tanks is always calculated in advance so that the desired depth is achieved correctly. Occurs that the craft usual of tourism underwater operates without need of water tanks, because they have their own weight to keep themselves semi-submerged. As a consequence, its greater weight and drag make navigation slow, reduce autonomy and result in higher fuel consumption. Current technologies, when they present ballast water tanks, are usually located below the water level.

Underwater tourism of observation is a modality that has been gaining more and more adherents. The practice arose from the need for scientific studies, and the marine wealth ands shipwrecks of boats began to stimulate the curiosity of tourists all over the world in search of oceanic exploration. The usual techniques employed in the constructions of underwater tourism vessels are diverse.

The document BR 11 2013 026983 9 describes a hybrid ascending tube system comprising a bottom-up tube section fixed between an inferior subsea anchor and a superior floating structure, and a superior upward tube section extending between the bottom ascending tube section and a vessel on the surface or near the surface. The bottom ascending tube section comprises an elongated bracket and one or more composite fluid conduits fixed and extending adjacent to the elongated bracket.

The document BR 11 2014 016806 7 describes a water vehicle comprising: a deck to accommodate a plurality of passengers; a hull disposed to withstand a portion of the deck above a water line; and an observation gondola extending beneath the waterline and safe in relation to the deck when configured in underwater observation mode, and the observation gondola comprises: a transparent floor; seats to accommodate the plurality of passengers; a higher portion including an open area above the seat, while the open area overlaps at least 50% of the seat extending through the deck above the gondola and exposed to the atmosphere; and a plurality of transparent walls, to accommodate the plurality of passengers below the waterline.

Further, U.S. Pat. No. 5,988,088 describes an underwater tourism vessel, in which a plurality of displacement bodies for tours equipped with underwater observation rooms is proportionate and parallel with a fixed distance between them, in which bodies of floating cavities are proported outside each of the displacement bodies.

The US 2003/164132 document describes a floating body, in particular as a transporter of an underwater tunnel that has a rigid support structure in the form of a horizontal grid, in the rectangular open spaces, in particular squares of the grid of which hollow bodies, which can be used as tanks, flotation bodies, ballast bodies, storage chambers or similar, are safe.

The U.S. Pat. No. 4,087,980 document reveals a spherical subsea air chamber made of a flexible material in which people can observe the underwater condition and the seabed from a scientific or recreational point of view.

And, the CN 101229842 document reveals a detachable multifunctional diving and touring yacht. A lower part of the yacht in the water has an underwater observation booth of ascent and descent; both ends of the underwater observation booth are provided with air circulation tubes; the middle of the air circulation tubes is provided with a lift and descent; the circumference of the underwater observation booth is provided with a meshy dive chamber that is integrated into a whole with the underwater tour cabin through a climbing and descending positioning rod; the underwater observation booth is hung on a hoisting device of the yacht.

In view of the above, it is possible to observe a wide variety of constructions in the scope of underwater observation vessels and ballast systems. However, the alternatives are restricted exclusively to vessels with observation by means of glass (or transparent material) vigils in the hull or by means of cabins submerged into water. In both cases There are no ballast water tanks or, when they exist, these are located below the water level.

Therefore, there is no state of the art solution equivalent to the one presented here in the present invention that combines technical differentials, economic advantages, safety and reliability, as described later.

OBJECTIVES OF THE INVENTION

It is a purpose of the present invention a hybrid vessel that allows the cabin submersion according to the decision of its operator and comprises at least one cabin and at least one ballast water tank.

Another objective of the present invention is a ballast water system for the aforementioned vessel that ensures its efficient operation.

INVENTION SUMMARY

The present invention achieves these and other objectives by positioning the ballast water tank that is wholly or partially above the water level.

Further, the present invention achieves these and other objectives by means of a hybrid vessel in which the position of the cabin is changed vertically, from emerged to submerged and vice versa, by an operator.

DETAILED DESCRIPTION OF DRAWINGS

The present invention will be better detailed and elucidated based on the following figures.

DETAILED DESCRIPTION OF THE INVENTION

Figure 1:
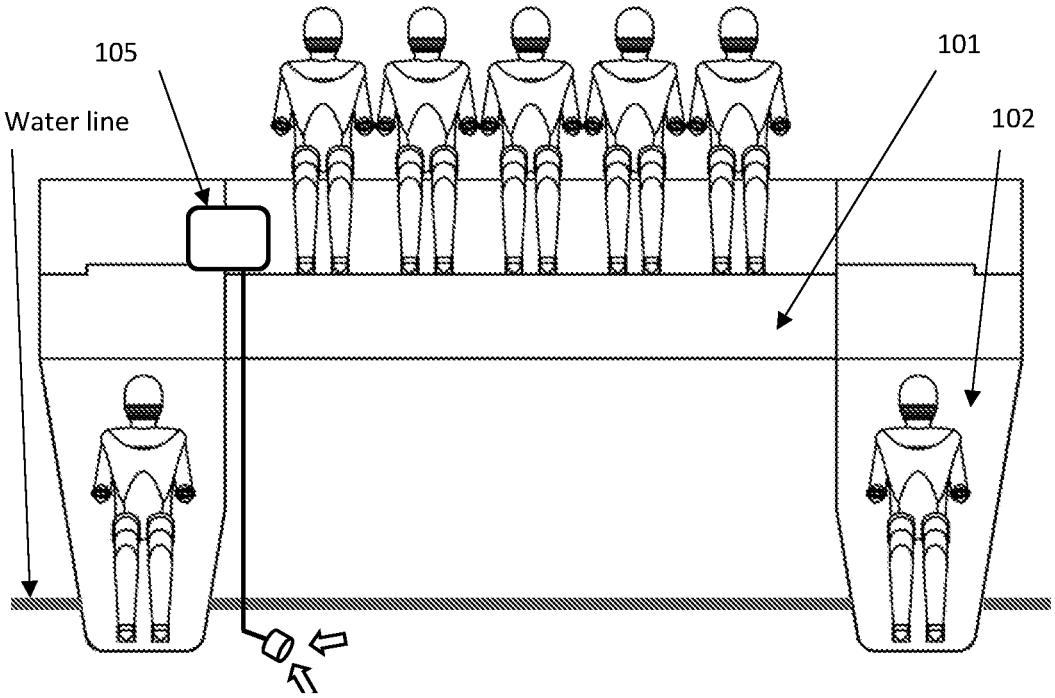
FIG. 1 illustrates an illustrative scheme of a first preferred embodiment comprising a cabin and an empty main tank of ballast water.

In the search for a more agile and dynamic submarine observation vehicle, the applicant of this patent application has developed an innovative hybrid vessel, with a ballast water system that allows the positioning of its tank 101, 104 above water level, ideal for touristic purposes, leisure, environmental monitoring, underwater inspections and other applications in the aquatic industry.

The tank 101, 104 with ballast above the water level, when full of water, allows underwater observation to compensate for the thrust of the submersible of the cabin 102, allowing to use the water from the observation site to increase the weight of the vessel. On the other hand, the tank 101, 104 with ballast above the water level, when in cruise mode is empty, reducing the weight of the vessel and, consequently, its draught. This is the great advantage of the technology described, because the vessel does not require its own ballast to overcome the thrust for submersion, which makes it lighter and agile, more economical and safer, besides allowing its land transport in conventional trailers in cases of small versions.

Other vessels with the same volume of submerged cabin are not known in the state of the art to allow underwater observation, which have the equivalent or lesser weight to that of the hybrid vessel of this invention. On the contrary, all equivalent vessels in dipped volume have a significantly higher weight, consuming much more fuel in displacement when in navigation, in addition to are less agile and require special land transport (which implies high cost).

It is the present invention, also, of a system designed to provide greater comfort and different visual perceptions for its users. In addition, the system admits a significant flexibility of settings for its vessels.

The concept of hybrid vessel of this invention originates from the fact that its cabin allows the user to be able to observe what is outside and within the aquatic environment according to its wish. In other words, the cabin 102 can be maneuvered vertically up or down the water level, altering from the emerged position to submerse (for underwater observation) and vice versa at its operators discretion.

This versatility of cabin 102 represents a breakthrough in the water transport market, and innovation is the result of studies and researches that have brought together technical conditions to be achieved greater energy efficiency, greater versatility besides the reduction of structural efforts due to the better hydrodynamic when in navigation.

Preferably, the displacement of the vessel is carried out in cruise mode, with the cabin 102 above the water level, from the place of departure to the point of observation. Once the destination location has been reached, the vessel operator can change the position of the cabin 102 to the observation mode so that it is submerged and allows for underwater viewing. The differential is to use the water from the observation site itself to allow the submersion of the cabin 102 only in this condition, eliminating an excessive weight that the vessel would have if using the ballast tank underwater.

One of the advantages of the present invention is that the observation booth present on the vessel remains above the water level while the vessel is in cruise mode, this being a measure that provides greater security to users during long displacements in addition to reducing the effort on the structure of the vessel.

The advantage of the present invention is due to the strategic location of the tank 101, 104 of ballast water totally or partially above the water level, which enhances the efficiency and agility of the vessel, because the absence of fixed ballast benefits displacement, land transport and vessel management, as well as a decrease in drag during navigation.

The vessels treated in the present invention can navigate in cruise mode or observation mode, be of articulated or unarticulated type, integrated or not in the same structure, comprising one or more cabins 102 of observation, one or more floating hulls, one or more tanks 101, 104 of ballast water, with one or more people inside. Its construction can be performed with naval steel, aluminum or with composites, in metal structure or from the constructive material itself, or similar to a technician in the subject. The motorization can be through one or more outboard, center or hydrojet engines, powered by electric power, fossil fuels (such as gasoline, diesel or natural gas) or renewable (such as biodiesel or methanol).

When in cruise mode, the cabin(s) 102 of observation can be closed or opened and possess(es) air-conditioned environment; and in observation mode, it is foreseen that the same remain(s) closed. Underwater observation windows are constructed of laminated glass, polycarbonate or acrylic, dimensioned according to the geometry and extent of the exposure surface and the pressure of the desired water column.

With regard to tank 101, 104 of water ballast, the system of the present invention is designed so that it is situated totally or partially above the water level during observation mode, it uses water from the aquatic environment in which it is located to change the cabin level.

It is worth noting that the nautical culture, consolidated in millennia, always interpreted the ballast water tank as a vessel stabilization structure and not as a weight that allowed a lever to compensate for the thrust of the submersion of the vessels. Within the vision of pure and simple stabilization, the placement of a ballast tank above the water level would be a countersink, as it would significantly increase the chance of adhering to the vessel. In addition, compensate the thrust of the cabin submersion only with the ballast water tank below the level of the water is impossible, because the volume of water displaced by the cabin would be annulled by the volume contained in the ballast, that is, the thrust added to the ballast would be zero. There are vessels that, by their own weight added to the ballast tank under water, overcome the thrust of the submersion. This is what a conventional submarine does. Thus, keeping the ballast water tank below the water level beyond innocuous to the submersion effect, represents an unnecessarily larger, heavier, less agile and more expensive vessel.

In the embodiments of the present invention, the instability resulting from the positioning of the ballast tank above the water level is compensated by usual design measures that increase its hydrostatic stability without requiring increased weight of, for example, the use of the catamaran format.

In a preferential embodiment, the present invention reveals a system comprising at least one cabin 102 and at least one tank 101 of ballast water in which the said tank 101 is connected directly to the cabin 102, total or partially above the water level, allowing moving the cabin 102 in a vertical direction in relation to the water level.

Cabin 102 preferably has enough size to comprise at least one passenger inside. The filling or emptying of at least one tank 101 of ballast water allows the cabin 102 to move vertically relative to the water level allowing the user(s) to be able to observe the underwater environment.

Figure 2:
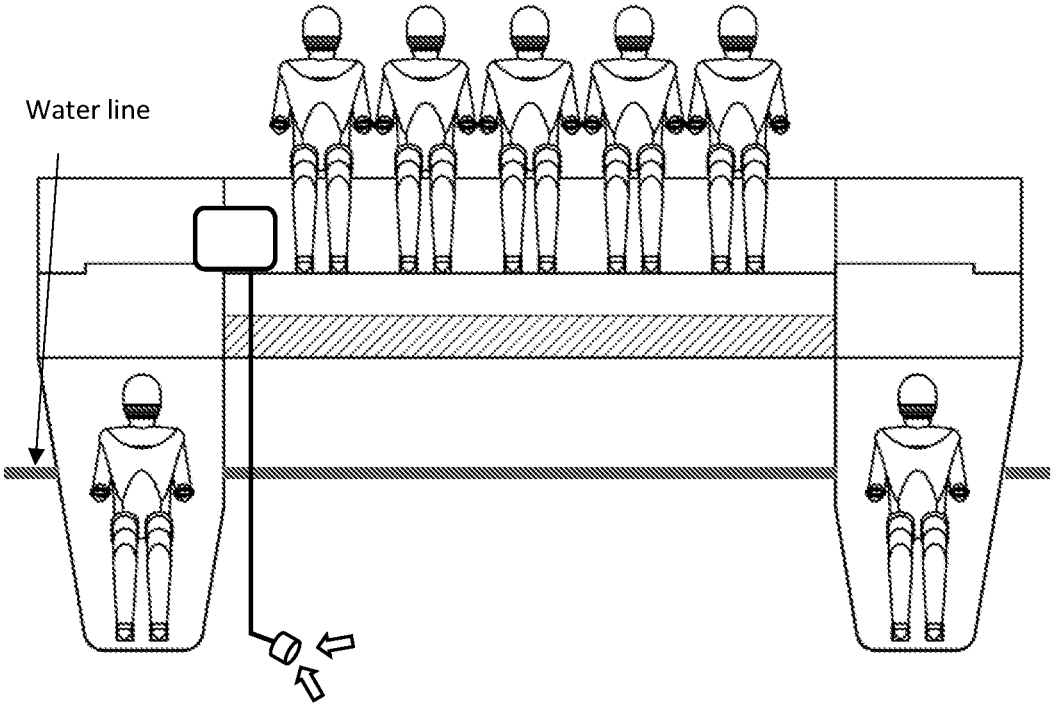
FIG. 2 illustrates an illustrative scheme of a first preferred embodiment comprising a cabin and a main tank partially filled with ballast water.
Figure 3:
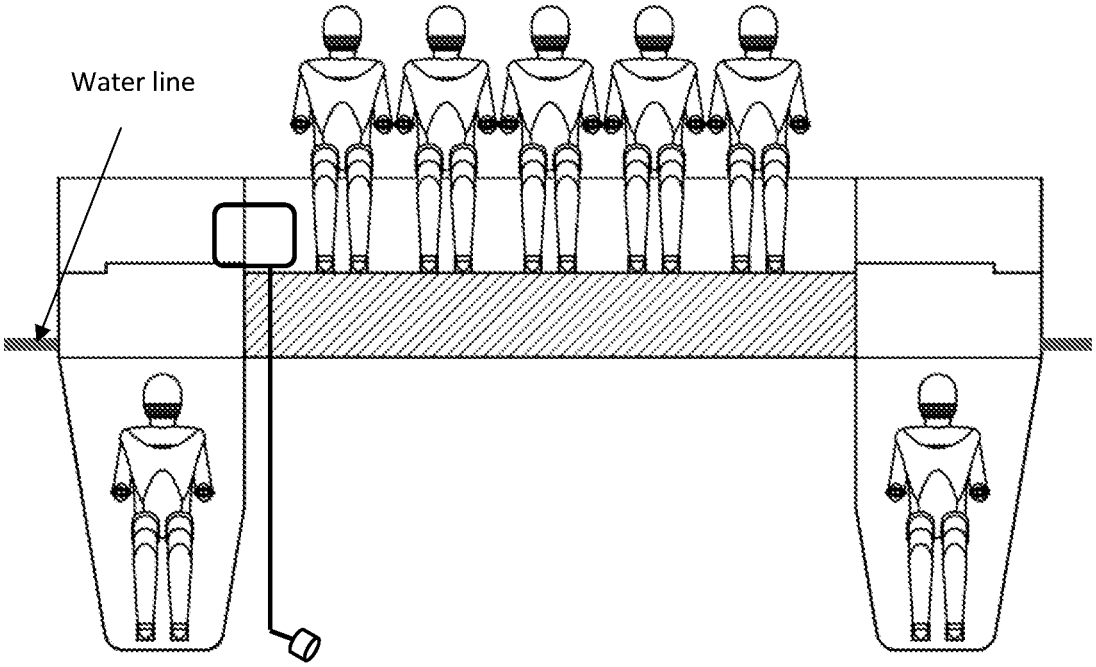
FIG. 3 illustrates an illustrative scheme of a first preferred embodiment comprising a cabin and a main tank completely filled with ballast water, having the cabin submerged below the water line.
Figure 4:
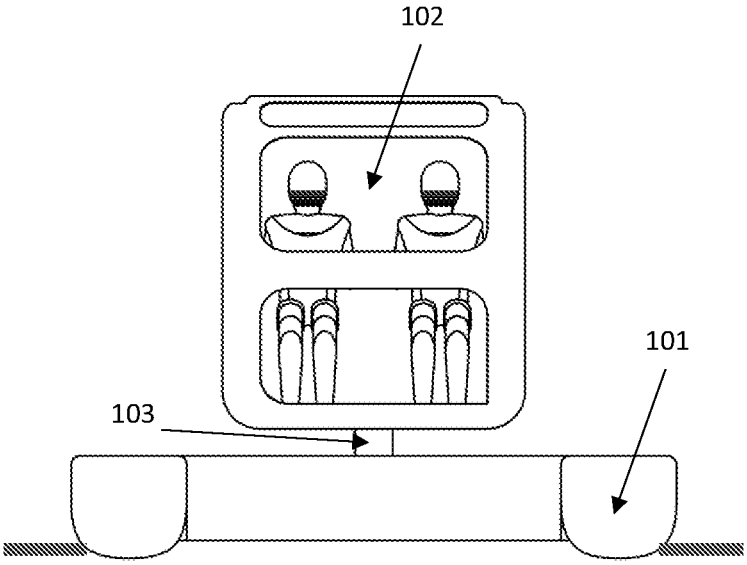
FIG. 4 illustrates an illustrative scheme of a second preferred embodiment comprising a cabin and two empty ballast water main tanks and a movement mechanism endowed with a mechanical arm.
Figure 5:
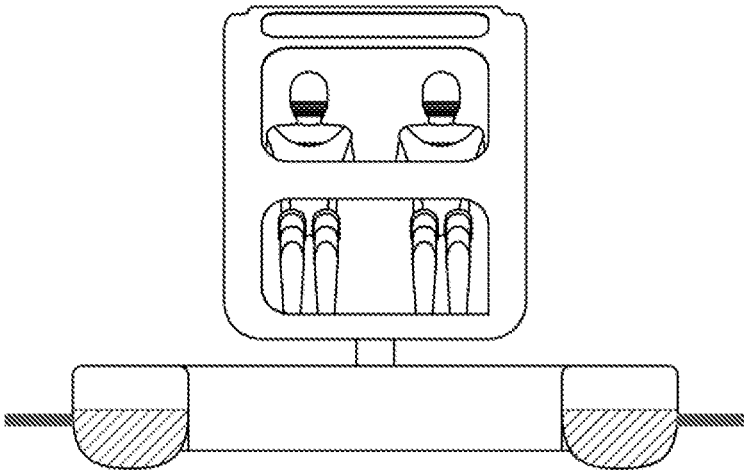
FIG. 5 illustrates an illustrative scheme of a second preferred embodiment comprising a cabin and two main tanks partially filled with ballast water and a movement mechanism endowed with mechanical arm.
Figure 6:
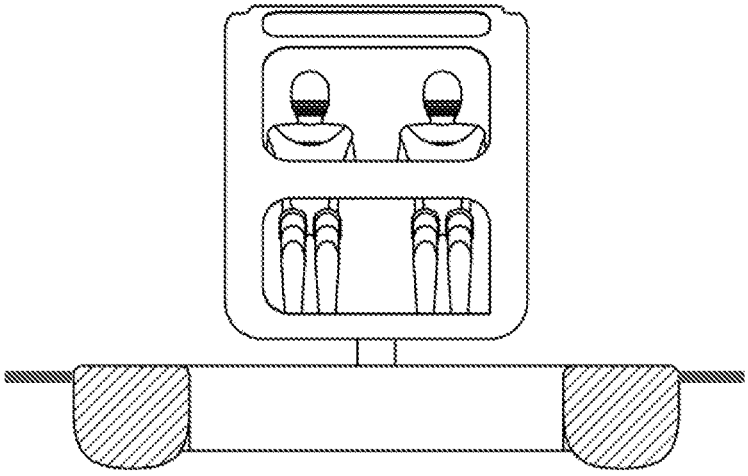
FIG. 6 illustrates an illustrative scheme of a second preferred embodiment comprising a cabin and two main tanks completely filled with ballast water and a movement mechanism endowed with mechanical arm.
Figure 7:
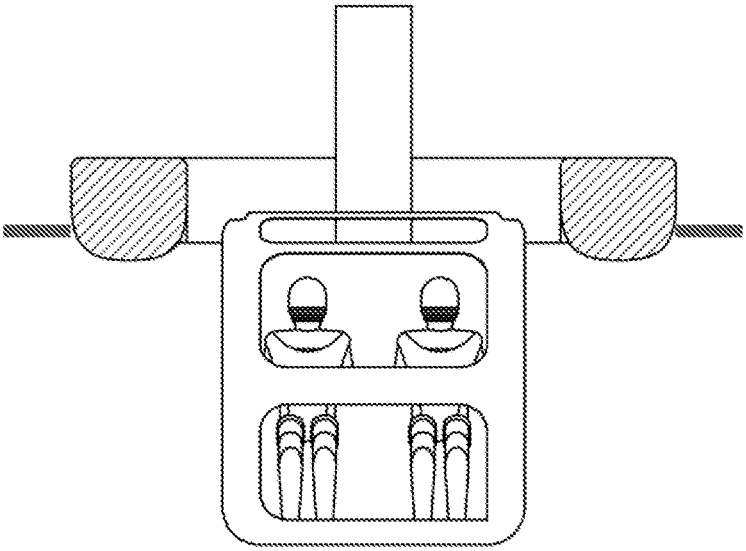
FIG. 7 illustrates an illustrative scheme of a second preferred embodiment comprising a cabin and two main tanks completely filled with ballast water and a mechanism of movement endowed with mechanical arm, having the cabin submerged below the water line.

FIGS. 1, 2 and 3 illustrate a first preferred embodiment of the present invention comprising in addition at least one water pump 105 which, when triggered, it fills at least one main tank 101 of ballast water. The filling of the ballast water tank 101 causes the entire vessel to have its weight increased and move vertically downwards, submerging until it reaches the height relative to the level of water that if one wishes to perform aquatic observation.

FIGS. 3, 4, 5, 6 and 7 illustrate a second preferred embodiment of the present invention comprising a cabin 102, two main tanks 101 of ballast water and a movement mechanism that preferably is a mechanical arm 103. Said arm 103 connects the cabin 102 to the hull of the vessel which, in turn, is directly connected to at least one tank 101 of ballast water. Optionally, it is foreseen that the present embodiment only presents a tank 101 of ballast water located in any location of the boat.

Tanks 101 can be filled with water by means of a pump or by gravity and valve manoeuvre. The minimum amount of ballast water required is calculated so that its weight compensate for the thrust of the cabin submersion.

The arm 103, when mechanically actuated, causes the submersion of the cabin 102 to move vertically downwards and submerging until it reaches the height relative to the level of water that is desired to perform the observation of the submarine environment.

Figure 8:
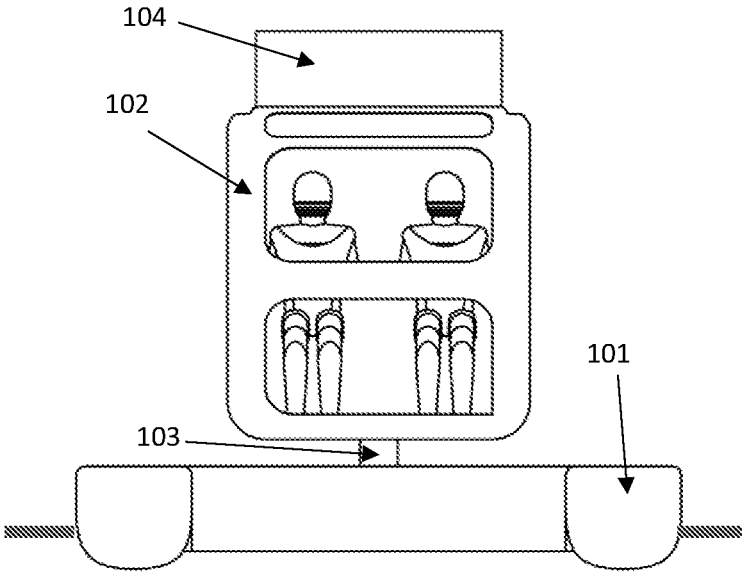
FIG. 8 illustrates an illustrative scheme of a third preferred embodiment comprising an additional empty ballast water tank located above the cabine.
Figure 9:
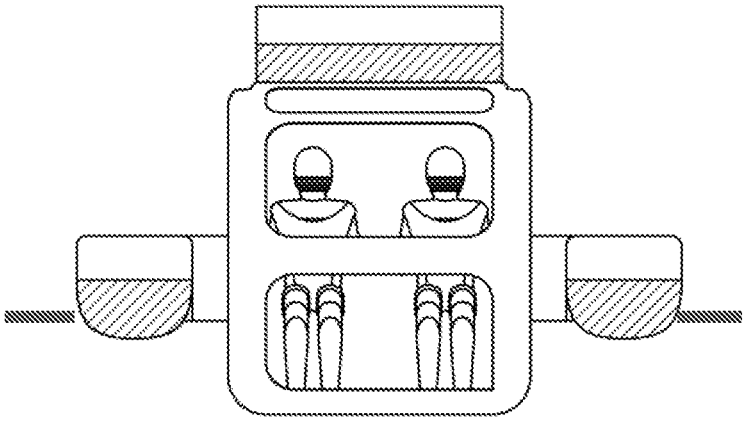
FIG. 9 illustrates an illustrative scheme of a third preferred embodiment comprising an additional tank partially filled with ballast water located above the cabin.
Figure 10:
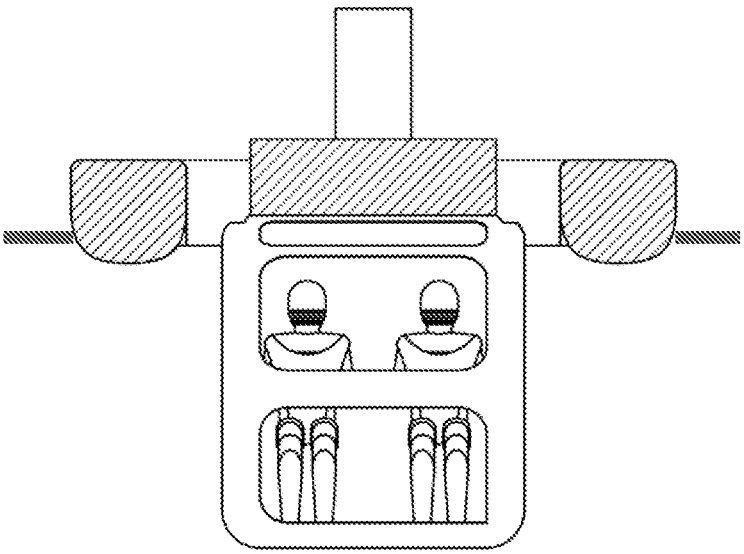
FIG. 10 illustrates an illustrative scheme of a third preferred embodiment comprising an additional tank completely filled with ballast water located above the cabin, being the cabin submerged below the water line.

In a third preferred embodiment of the present invention illustrated by FIGS. 8, 9 and 10, there is an additional tank 104 of ballast water located above the cabin 102, which moves together with the same, and two other main tanks 101 ballast. In this embodiment it is possible to observe also a mechanism of movement, a mechanical arm 103, that can be triggered in order to promote the movement of the cabin 102. It Is also possible to the presence of only one tank of ballast water 104 above the cabin 102 that has enough weight to be at the thrust of the cabin 102 without requiring a mechanical arm 103 active nor the main tanks 101 of water ballast.

Figure 11:
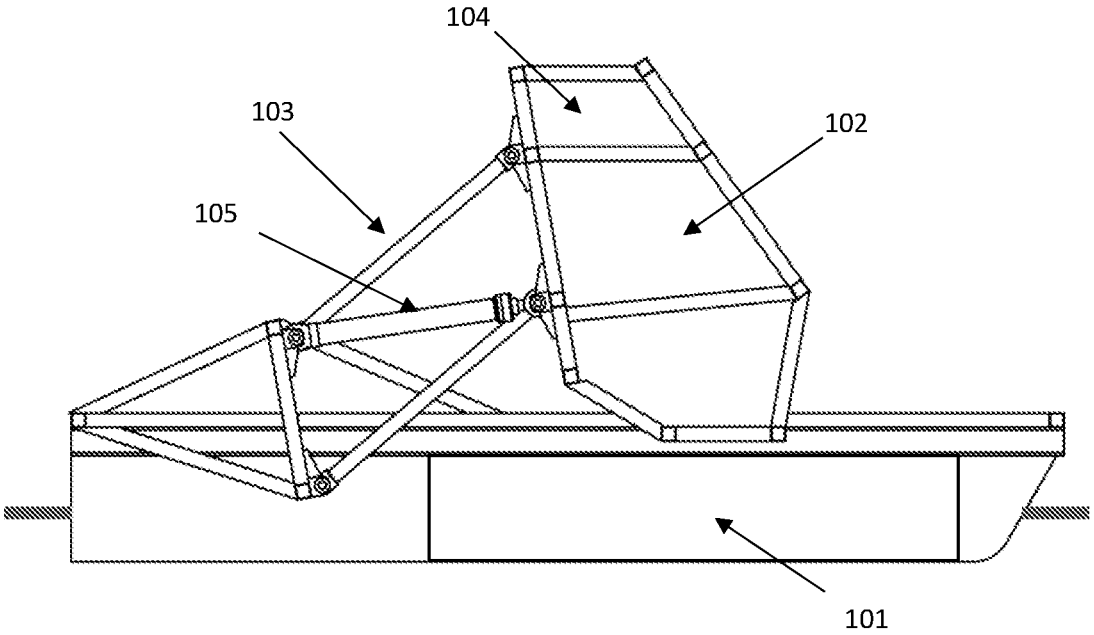
FIG. 11 illustrates an illustrative scheme of a fourth preferred embodiment comprising an empty main ballast water tank as well as an empty additional tank located above the cabin, and a motion mechanism endowed with articulated quad system.
Figure 12:
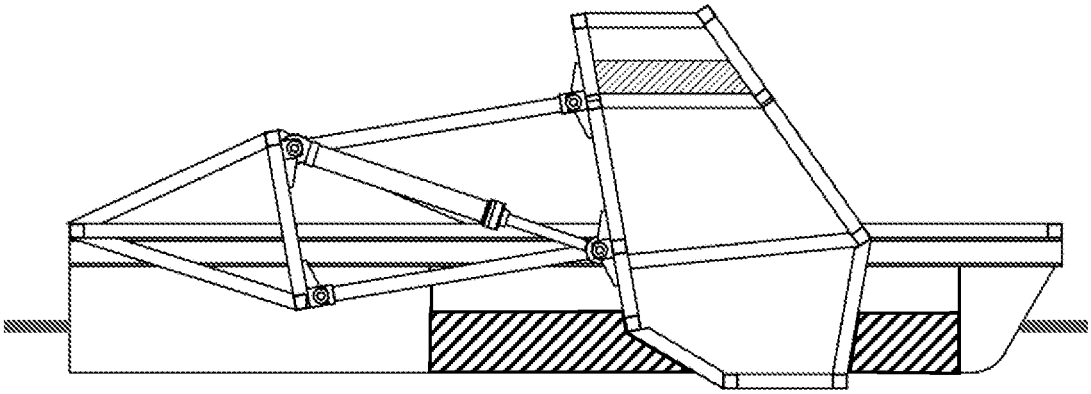
FIG. 12 illustrates an illustrative scheme of a fourth preferred embodiment comprising a main tank partially filled with ballast water, as well as an additional tank partially filled with ballast water located above the cabin, and a motion mechanism endowed with articulated quad system.
Figure 13:
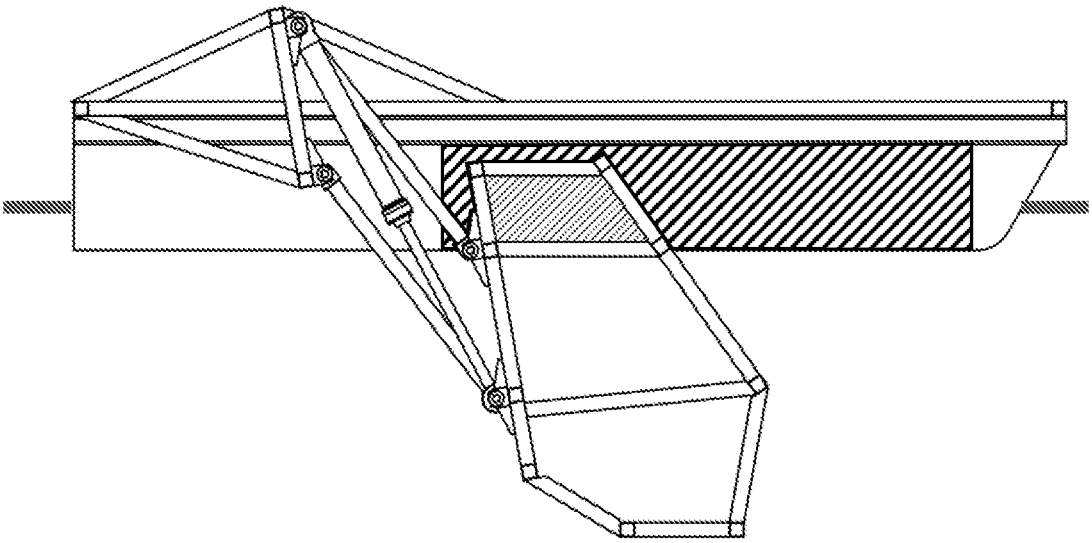
FIG. 13 illustrates an illustrative scheme of a fourth preferred embodiment comprising a main tank completely filled with ballast water, as well as an additional tank completely filled with ballast water located above the cabin, and a motion mechanism endowed with articulated quad system, being the cabin submerged.

FIGS. 11, 12 and 13 illustrate a fourth preferred embodiment of the present invention comprising an additional tank 104 of ballast water located above the cabin 102 and another tank main 101 of ballast water inside the vehicle hull. This vessel presents a movement mechanism, preferably the mechanical arms 103 endowed of quads system articulated, driven by hydraulic system 105, which assists in moving the cabin 102 up or down relative to the water level. It is also possible the presence of only one tank 101 of ballast water inside the hull of the vehicle, dispensing the additional tank 104 ballast water above the cabin 102.

Figure 14:
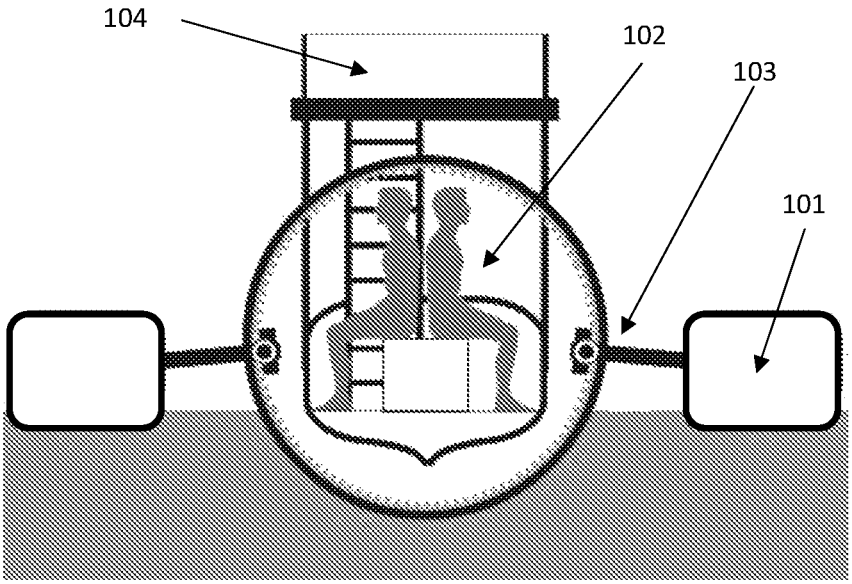
FIG. 14 illustrates an illustrative scheme of a preferred fifth embodiment comprising two empty main ballast water tanks as well as an additional tank empty located above the cabin and a mechanism of motion equipped with gears.
Figure 15:
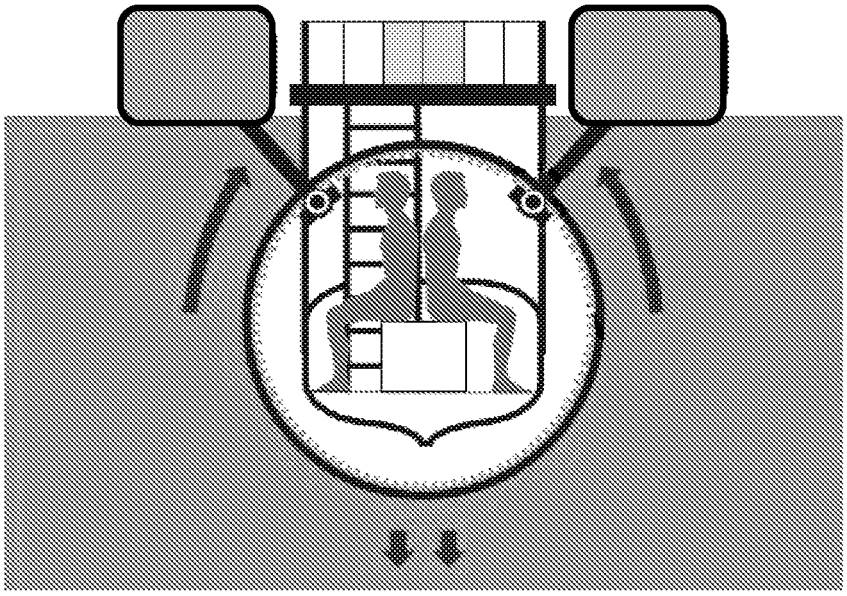
FIG. 15 illustrates an illustrative scheme of a preferred fifth embodiment comprising two main tanks completely filled with ballast water as well as an additional tank partially filled with fixed ballast water located above the cabin and a motion mechanism equipped with gears, with the cabin submerged.
Figure 16:
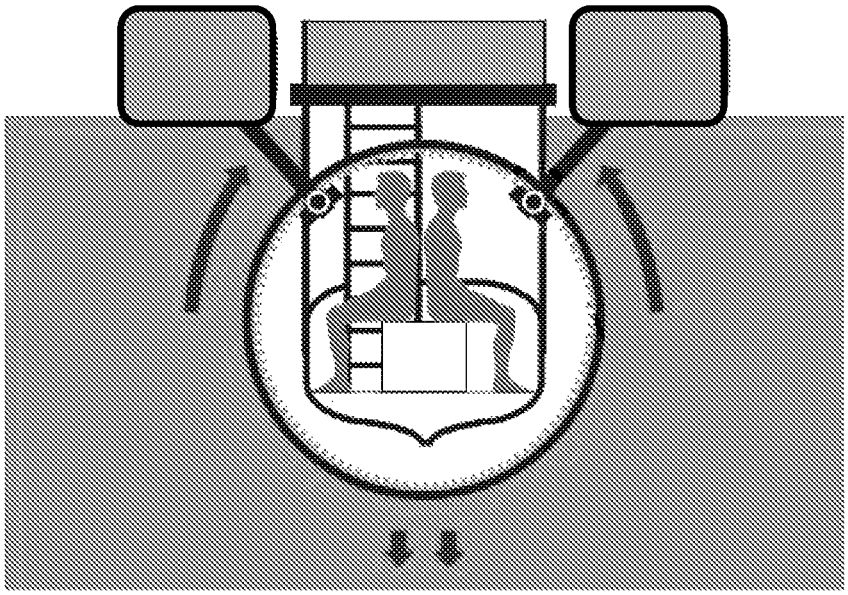
FIG. 16 illustrates an illustrative scheme of a preferred fifth embodiment comprising two main tanks completely filled with ballast water as well as an additional tank completely filled with fixed ballast water located above the cabin and a motion mechanism equipped with gears, with the cabin submerged.

FIGS. 14, 15 and 16 illustrate a fifth preferred embodiment of the present invention comprising a movement mechanism, preferably mechanical arms 103 composed of gears and turnstiles, connected to two respective main tanks 101 of ballast water. In this embodiment it is also possible to observe an additional tank 104 ballast water located above the cabin 102, which moves together with the same. Said tanks 101 and 104 can be filled with ballast water independently each other or in a joint way.

Figure 17:
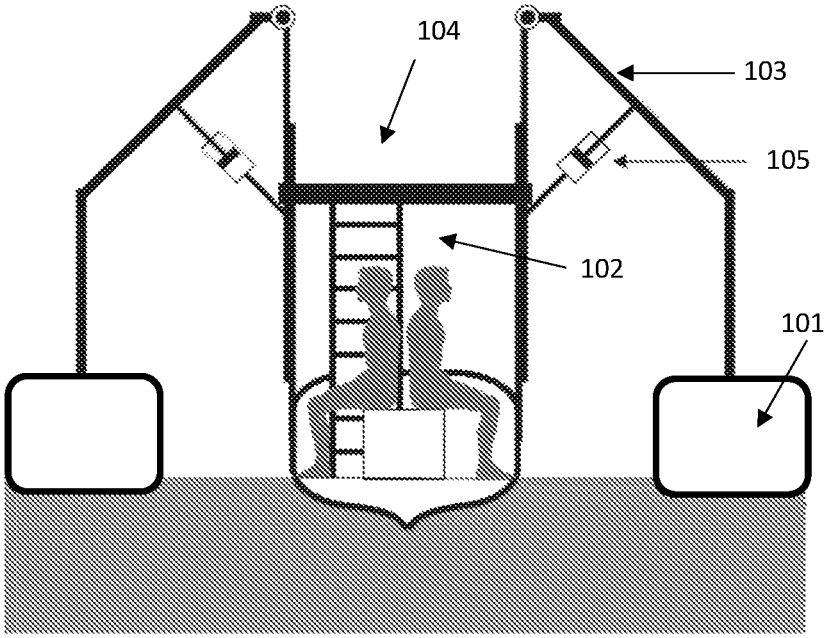
FIG. 17 illustrates an illustrative scheme of a sixth preferred embodiment comprising two empty main ballast water tanks as well as an additional empty ballast water tank located above the cabin and a motion mechanism equipped with a hydraulic system.
Figure 18:
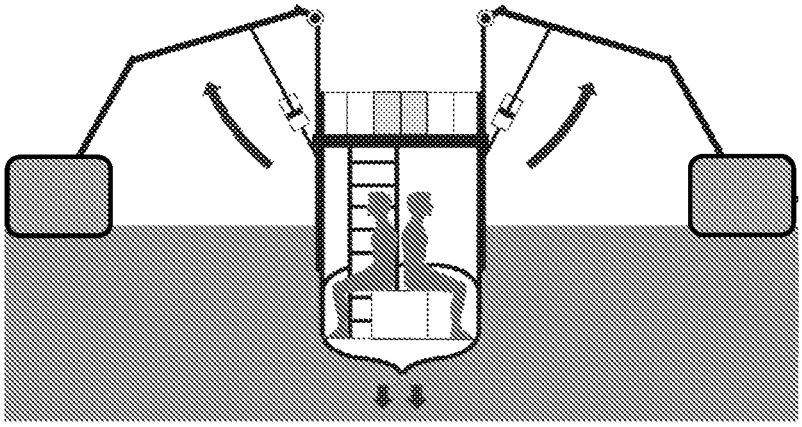
FIG. 18 illustrates an illustrative scheme of a sixth preferred embodiment comprising two main tanks completely filled with ballast water as well as an additional tank partially filled with ballast water located above the cabin and a motion mechanism equipped with a hydraulic system, with the cabin partially submerged.

In a sixth preferred embodiment of the present invention illustrated by FIGS. 17 and 18, an additional tank 104 of ballast water is observed located above the cabin 102 and two other main tanks 101 of ballast water connected to a movement mechanism, preferably mechanical articulable arms 103 driven by hydraulic system comprising pistons 105, which assists in the handling of the cabin 102.

Figure 19:
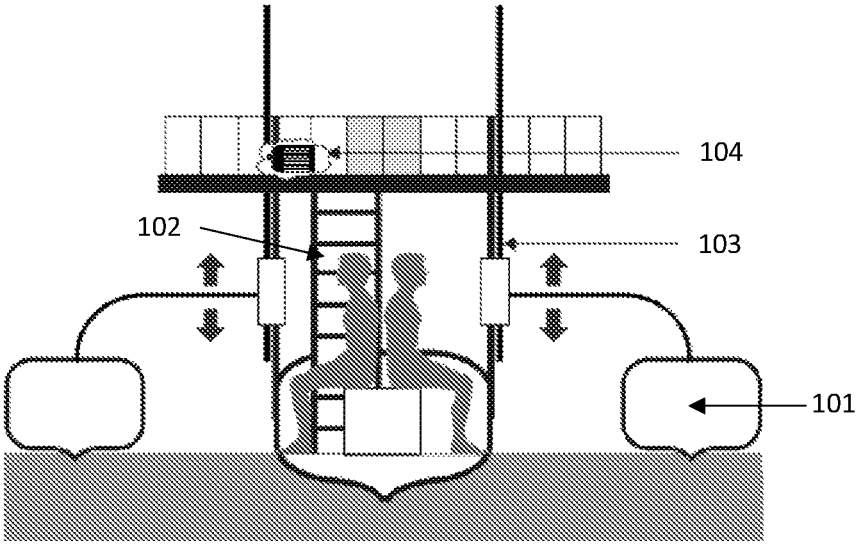
FIG. 19 illustrates an illustrative scheme of a seventh preferred embodiment comprising two empty main ballast water tanks as well as an additional tank partially filled with ballast water located above the cabin and a motion mechanism equipped with a motorized system.
Figure 20:
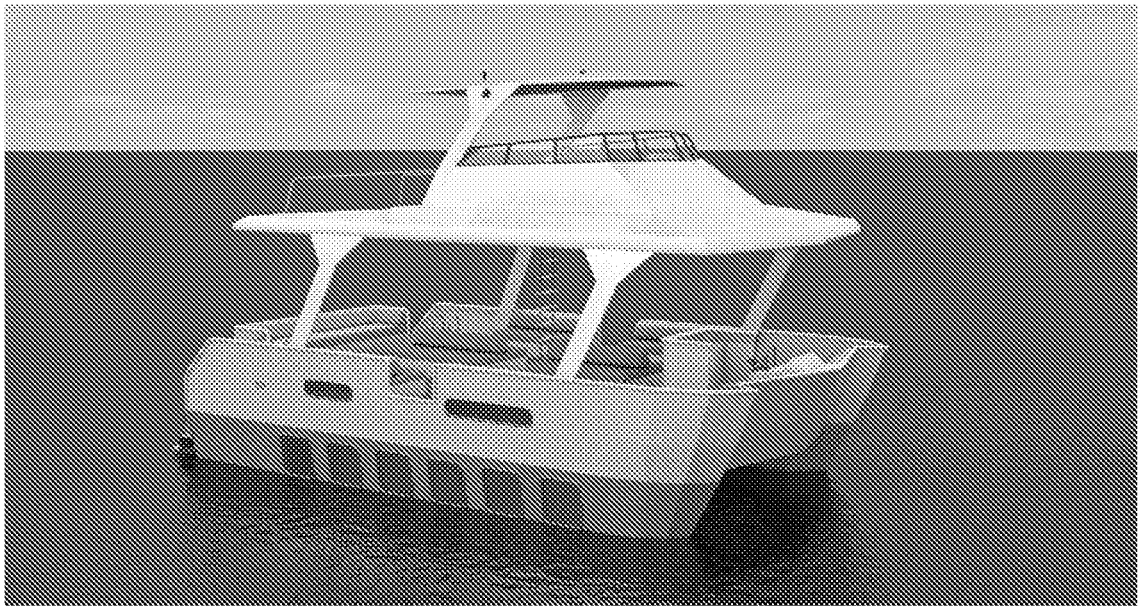
FIG. 20 illustrates a 3D model scheme of an executable project, with no mechanism between the cabin and the hull of the vessel.
Figure 21:
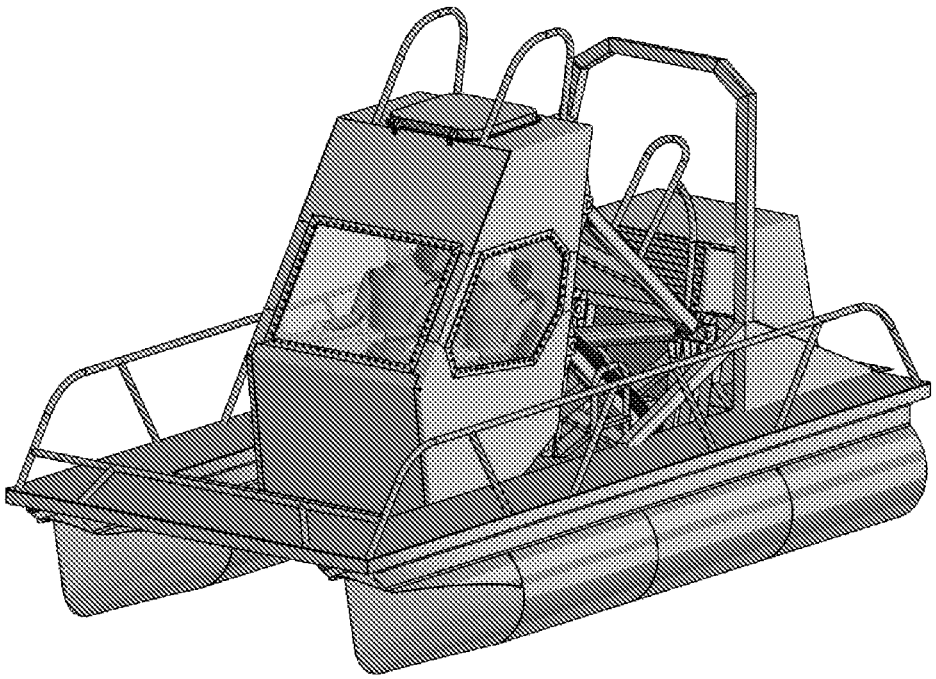
FIG. 21 illustrates a 3D model schema of an executable project, with a moving mechanism between the cabin and the hull of the vessel.

FIG. 19 illustrates a seventh preferred embodiment of the present invention in which it is possible to notice the presence of an additional ballast water tank 104 located above the cabin 102 and two other main tanks 101 of ballast water respectively connected to a movement mechanism, preferably mechanical articulable arms 103 driven by motorized system comprising a bolt and a nut (or a pinion and a rack), which assists in the movement of the cabin 102.

As an illustration of two of the preferred embodiments of the present invention, 3D models of two executable projects are presented.

Having been described an example of a preferred embodiment of the present invention, it should be understood that the scope of the present invention encompasses other possible variations of the inventive concept described, being limited only by the content of the claims including the possible equivalents.

The invention claimed is:

1. A hybrid vessel with ballast water system comprising:

a) at least one cabin;

b) at least one main tank of ballast water; the at least one main tank connected directly to the cabin in total or partially above the water level; and c) an additional main tank of ballast water located above the at least one cabin;

wherein the system comprises at least one movement mechanism endowed with a mechanical arm connecting the at least one cabin to the at least one main tank of ballast water, said mechanical arm being selected from the group consisting of an articulated quad system, gears, a hydraulic system, and an electrical system.

2. The hybrid vessel with ballast water system according to claim 1, wherein the system comprises two main tanks of ballast water arranged laterally.

3. The hybrid vessel with ballast water system according to claim 1, wherein the main tanks are filled with ballast water by a water pump, gravity, or a valve maneuver.

4. A hybrid vessel with ballast water system comprising:

a) at least one cabin;

b) at least one main tank of ballast water; the at least one main tank connected directly to the cabin in total or partially above the water level, wherein the main tanks are filled with ballast water by a water pump, gravity, or a valve maneuver;

wherein the amount of water that fills the main tanks-is calculated based on a weight of the main tanks and a thrust of the at least one cabin submersion; and wherein the system comprises at least one movement mechanism endowed with a mechanical arm connecting the at least one cabin to the at least one main tank of ballast water, said mechanical arm being selected from the group consisting of an articulated quad system, gears, a hydraulic system, and an electrical system.

5. The hybrid vessel with ballast water system according to claim wherein the main tanks are filled with ballast water independently of each other or in a joint manner.

6. The hybrid with ballast water system according to claim 5, wherein the main tanks are filled when the at least one cabin is found in a cruise mode and/or observation.

7. The hybrid vessel with ballast water system according to claim 1, wherein the mechanical arm connects the at least one cabin to a hull of the vessel.

8. The hybrid vessel with ballast water system according to claim 1, wherein the at least one movement mechanism endowed with a mechanical arm moves the at least one cabin vertically relative to the water level.

9. The hybrid vessel with ballast water system according to claim 1, navigating with empty ballast main water tanks.

10. The hybrid vessel with ballast water system according to claim 9, wherein a displacement is carried out with the at least one cabin above the water level.

11. The hybrid vessel with ballast water system according to claim 10 wherein the at least one cabin is climatized.

12. The hybrid vessel with ballast system according to claim 1, the at least one cabin comprising at least one underwater observation window.

13. The hybrid vessel with ballast system according to claim 12, wherein the window is constructed with a material selected from the group consisting of: laminated glass, polycarbonate and acrylic.

14. The hybrid vessel with ballast system according to claim 1, constructed with a material selected from the group consisting of naval steel, aluminum and composites, in metallic structure or own constructive material.

15. The hybrid vessel with ballast system according claim 1, wherein a motorization is selected from the group consisting of one or more outboard motors, center or hydrojets, powered by electric power, fossil and renewable fuels.

16. The hybrid vessel with ballast system according claim 1, wherein the at least one cabin is maneuvered by an operator.

17. The hybrid vessel with ballast system according to claim 16, wherein a position of the at least one cabin is changed vertically from emerged to submerse and vice versa.

* * * * *